US008380096B2

(12) United States Patent
Kogure et al.

(10) Patent No.: US 8,380,096 B2
(45) Date of Patent: Feb. 19, 2013

(54) IMAGE FORMING APPARATUS WITH PULL-IN PATH FOR RECORDING MEDIUM

(75) Inventors: Seiichi Kogure, Yamato (JP); Yasumasa Mihara, Ebina (JP)

(73) Assignee: Ricoh Company, Ltd., Tokyo (JP)

( * ) Notice: Subject to any disclaimer, the term of this patent is extended or adjusted under 35 U.S.C. 154(b) by 411 days.

(21) Appl. No.: 12/460,633

(22) Filed: Jul. 22, 2009

(65) Prior Publication Data

US 2010/0021192 A1 Jan. 28, 2010

(30) Foreign Application Priority Data

Jul. 22, 2008 (JP) ..... 2008-189178

(51) Int. Cl.
*G03G 15/00* (2006.01)

(52) U.S. Cl. ..... 399/66; 399/45

(58) Field of Classification Search ..... 399/45, 399/66, 364
See application file for complete search history.

(56) References Cited

U.S. PATENT DOCUMENTS

| | | | | |
|---|---|---|---|---|
| 7,334,858 | B2 | 2/2008 | Kogure et al. | |
| 2007/0103532 | A1 | 5/2007 | Imoto et al. | |
| 2007/0109385 | A1 | 5/2007 | Imoto et al. | |
| 2007/0237541 | A1* | 10/2007 | Johnson et al. | 399/107 |
| 2008/0043083 | A1 | 2/2008 | Imoto et al. | |
| 2008/0106566 | A1 | 5/2008 | Kogure et al. | |
| 2008/0145123 | A1 | 6/2008 | Kogure et al. | |
| 2009/0052917 | A1 | 2/2009 | Kogure et al. | |
| 2009/0058911 | A1 | 3/2009 | Kogure et al. | |

FOREIGN PATENT DOCUMENTS

| | | | |
|---|---|---|---|
| JP | 05097113 A | * | 4/1993 |
| JP | 10-297038 | | 11/1998 |
| JP | 2004-18195 A | | 1/2004 |
| JP | 2005-335911 A | | 12/2005 |
| JP | 2006-027799 A | | 2/2006 |
| JP | 2006056682 A | * | 3/2006 |
| JP | 2006-264930 A | | 10/2006 |
| JP | 2007-62238 A | | 3/2007 |
| JP | 2007-152792 A | | 6/2007 |
| JP | 2007-196617 A | | 8/2007 |

OTHER PUBLICATIONS

Machine translation of JP 2006-056682 A, date Mar. 2, 2006.*

* cited by examiner

*Primary Examiner* — Walter L Lindsay, Jr.
*Assistant Examiner* — Ruth Labombard
(74) *Attorney, Agent, or Firm* — Cooper & Dunham LLP

(57) ABSTRACT

An image forming apparatus including an image formation device that forms an image on a recording medium at an image formation position; a transfer path that reverses and transfers the recording medium to the image formation position; a pair of rotation rollers that nip the recording medium in the transfer path at an upstream position relative to the position where the recording medium is completely reversed; a pull-in path provided at a downstream position relative to the pair of rotation rollers situated in the transfer path, to which the recording medium is pulled in; and a transfer control device that controls pulling in the recording medium to the pull-in path after the rear end of the recording medium passes through the pair of rotation rollers when the recording medium is fed to and transferred in the transfer path, wherein no pair of rollers that impart a transfer force to the recording medium are provided in the pull-in range of the recording medium in the pull-in path.

7 Claims, 12 Drawing Sheets

IMAGE FORMING APPARATUS WITH PULL-IN PATH FOR RECORDING MEDIUM

BACKGROUND OF THE INVENTION

1. Field of the Invention

The present invention relates to an image forming apparatus.

2. Discussion of the Background

An image forming apparatus employing a liquid discharging recording system using a recording head that discharges ink droplets are used as, for example, a printer, a facsimile machine, a photocopiers, a plotter and a multiple function machine. The image forming apparatus employing this liquid discharging recording system form, record, print, or print and transfer images by discharging ink droplets from the recording head to a recording medium while in transfer. The image forming apparatus is typified into a serial type image forming apparatus in which the recording head discharges ink droplet to form images while moving in the main scanning direction and a line type image forming apparatus in which images are formed by ink droplets discharged from the recording head without moving the recording head.

In the present invention, the image forming apparatus employing liquid discharging recording system represents a device that forms images by landing ink on a medium such as paper, thread, fiber, cloth, leather, metal, plastic, glass, wood or ceramics. The image formation represents providing a meaningless image such as a pattern to a medium (i.e., simply landing droplets onto a medium), in addition to provision of images having a meaning such as a letter or a drawing. The ink is not limited to ink in a generic sense but includes all the liquids such as recording liquid or fixing disposal liquid that can be used for image formation. Material for use in the recording medium is not limited to paper but includes a transparent sheet, cloth, etc. where ink droplets are attached. Therefore, the recording medium is used as a generic term that includes a recorded medium, a recording sheet (paper), etc.

In the image forming apparatus employing such liquid discharging system, precision of landing the liquid droplets discharged from the recording head is required to improve the quality of formed images. In addition to the structure of the recording head that discharges droplets, the recording medium should be necessary to be precisely transferred to secure good planarity of the recording medium, and the accurate distance between the recording head and the recording medium.

To improve the transfer accuracy and planarity, recording media are stuck to a transfer belt while in transfer. Also, displacement and floating of a recording medium is prevented by keeping a constant distance between the recording medium and the recording head and precisely controlling paper feeding of the recording medium. Thus, jamming due to contact between the recording medium and the recording head or contamination has been prevented.

Some image forming apparatuses include a transfer path which transfers a recording medium to the image formation position of the recording head and reverses the recording medium to change the direction thereof approximately 90° so that the feeding direction of the recording medium from the paper feeder is reversed to the transfer direction of the recording medium at the image formation position.

When a thick and/or stiff recording medium such as a post card is transferred through a transfer path having such a reverse portion (reverse path) and passes through the nip portion of a pair of rollers that are provided on the upstream side of the reverse portion relative to the recording medium transfer direction, such a thick and/or stiff recording medium paper tends to jump. This may cause deterioration of the feeding accuracy and lead to degradation of the quality of images.

There is an image forming apparatus which reduces displacement of a recording medium which causes accidental displacement of droplets due to the mechanical structure by releasing the pinching roller when the rear end of the thick recording medium passes through the nip (contact portion) formed between the transfer roller and the pinch roller.

In addition, a transfer path dedicated to transfer a thick recording medium is provided in some cases.

However, in the case of the image forming apparatus described above having a structure in which the pair of rollers are released when the recording medium passes through the nip portion formed between the transfer roller and the pinch roller at the reverse potion, the mechanism tends to be complicated and a timely release is difficult, thereby causing the image quality unstable. In addition, when a stiff recording medium such as a post card is used, the displacement caused after the pass-through of the pair of rollers increases, which may have a significant adverse impact on images.

SUMMARY OF THE INVENTION

Because of these reasons, the present inventors recognize that a need exists for an image forming apparatus having a simple structure which improves the image quality by reducing the deterioration of the transfer precision occurring when a recording medium passes through the pair of rotation rollers situated on the upstream of the reverse portion relative to the feeding direction of the recording medium.

Accordingly, an object of the present invention is to provide an image forming apparatus having a simple structure which improves the image quality by reducing the deterioration of the transfer precision occurring when a recording medium passes through the pair of rotation rollers situated on the upstream of the reverse portion relative to the feeding direction of the recording medium.

Briefly this object and other objects of the present invention as hereinafter described will become more readily apparent and can be attained, either individually or in combination thereof, by an image forming apparatus including an image formation device that forms an image on a recording medium at an image formation position; a transfer path that reverses and transfers the recording medium to the image formation position; a pair of rotation rollers that nip the recording medium in the transfer path at an upstream position relative to the position where the recording medium is completely reversed; a pull-in path provided at a downstream position relative to the pair of rotation rollers situated in the transfer path, to which the recording medium is pulled in; and a transfer control device that controls pulling in the recording medium to the pull-in path after the rear end of the recording medium passes through the pair of rotation rollers when the recording medium is fed to and transferred in the transfer path, wherein no pair of rollers that impart a transfer force to the recording medium are provided in the pull-in range of the recording medium in the pull-in path.

It is preferred that, in the image forming apparatus mentioned above, the pull-in path is at least part of a duplex transfer path through which the recording medium is re-fed at duplex printing.

It is still further preferred that, in the image forming apparatus mentioned above, the transfer control device controls pulling in the recording medium to the pull-in path based on at least one of thickness of the recording medium, kind of the recording medium, length of the recording medium, length and width of recording medium, load applied when the recording medium is transferred, environment temperature, history of environment temperature, date of usage, and region of usage.

It is still further preferred that, in the image forming apparatus mentioned above, the transfer control device controls a transfer speed of the recording medium when the recording medium is transferred back toward the image formation position after the recording medium is pulled in to the pull-in path to be slower than that of the recording medium when the recording medium is not pulled in to the pull-in path.

It is still further preferred that, in the image forming apparatus mentioned above, the transfer control device controls an acceleration of transfer speed of the recording medium when the recording medium is transferred back toward the image formation position after the recording medium is pulled in to the pull-in path to be slower than that of the recording medium when the recording medium is not pulled into the pull-in path.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The present invention will be described below in detail with reference to several embodiments and accompanying drawings.

First, a first embodiment of the image forming apparatus related to the present invention is described with reference to FIGS. 1 and 2.

Figure 1:
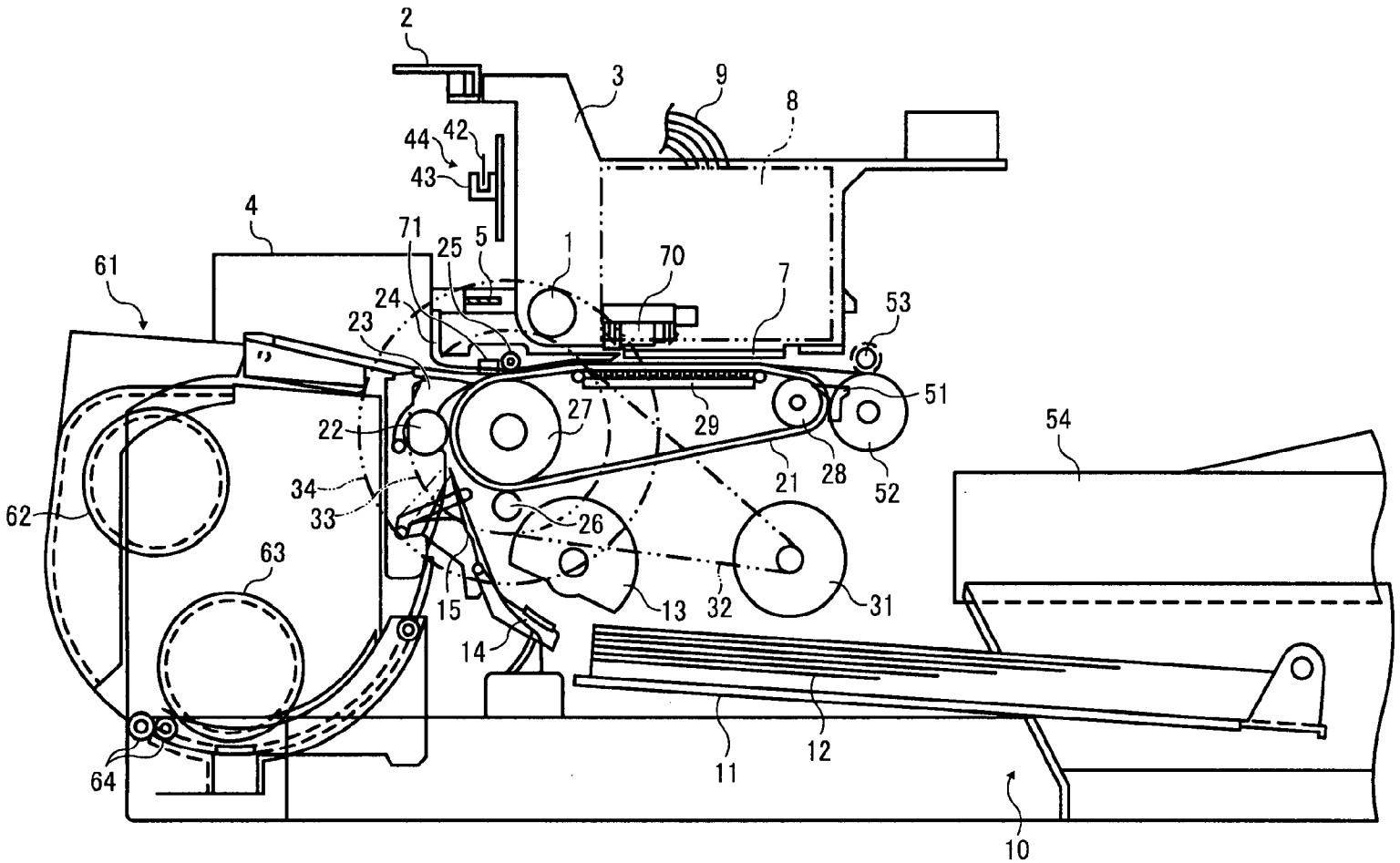
FIG. 1 is a side view illustrating the entire structure of the mechanical part of en example of the image forming apparatus of the present invention.
Figure 2:
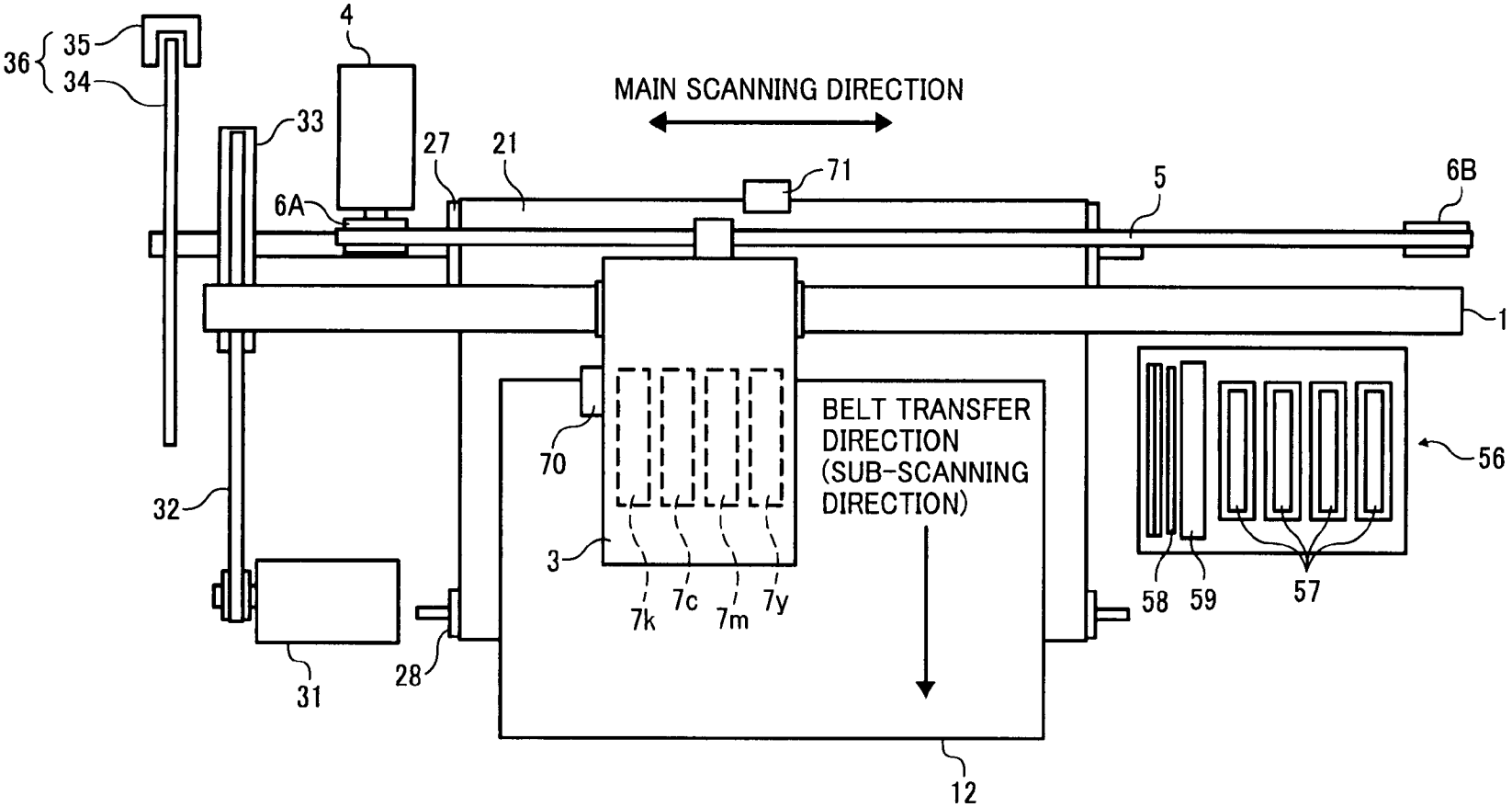
FIG. 2 is a plain view illustrating the mechanical part illustrated in FIG. 1.

FIG. 1 is a diagram illustrating a side view of the entire structure of the mechanism portion of the image forming apparatus and FIG. 2 is a plain view of the mechanism portion of the image forming apparatus.

In this image forming apparatus, a guide rod 1 and a guide rail 2 that lay across right and left lateral boards (not shown) slidably hold the a carriage 3 in the main scanning direction. A main scanning motor 4 moves the carriage 3 in the main scanning direction via a timing belt 5 suspended between a driving pully 6A and a driven pully 6B.

This carriage 3 includes four recording heads 7*y*, 7*c*, 7*m*, and 7*k* (referred to as recording head 7 when color is not necessary to be discriminated) functioning as image formation devices formed of liquid discharging heads that discharge ink droplets of yellow (Y), cyan (C), magenta (M), and black (B), respectively. Multiple ink discharging mouths (nozzles) are arranged on four recording heads in a direction crossing the main scanning direction with the ink discharging direction downward.

A device using a pressure production device to produce pressure for discharging liquid droplets can be used as the liquid discharging head that forms the recording head 7. Piezoelectric actuators such as piezoelectric elements, thermal actuators that utilize phase change by film evaporation of liquid using electric heat transformation element such as exothermic resistances, memory metal actuators that use metal phase change according to temperature change, and electrostatic actuators that use electrostatic force can be used as the pressure production device. In addition, the structure is not limited to a structure in which independent heads are arranged for each color. For example, a structure including one or more liquid discharging head having a nozzle array including multiple nozzles that discharge liquid droplets of multiple colors is also suitably used.

In addition, the carriage 3 includes a sub-tank for each color that supplies each color ink to the recording head 7. Ink is replenished from a main tank (ink cartridge) (not shown) to the sub-tank 8 via an ink supply tube 9.

A paper feeder unit such as a paper feeder cassette 10 that supplies a paper (recording medium) 12 placed on a paper loader (pressure plate) 11 includes a paper feeding roller 13 and a separation pad 14 made of material having a large friction coefficient that faces the paper feeding roller 13. The separation pad 14 is biased to the side of the paper feeding roller 13.

The paper 12 fed from the paper feeder unit is transferred on the bottom side of the recording head 7. Therefore, there are provided a transfer belt 12 that electrostatically adheres and transfers the paper 12, a registration roller (counter roller)

that pinches the paper 12 conveyed from the paper feeder unit via a guide 15 with the transfer belt 21, a transfer guide 23 that reverses the direction of the paper 12 transferred substantially 90° upward approximately 90° to make the transfer direction of the paper 12 the opposite to the paper feeding direction, and a pressure roller 25 biased to the side of the transfer belt 21 by a suppression member 24.

The reverse portion (reverse path) that reverses the paper 12 is formed of the surface of the transfer roller 27 over which the transfer belt 21 is suspended. The registration roller 22 is situated on the upstream side of the position where the paper 12 is completely reversed by the transfer belt 27. The transfer roller 27 forms a pair of rotation rollers with the registration roller 22. Furthermore, a charging roller 26 is provided as a charging device that charges the surface of the transfer belt 21.

The transfer belt 21 is an endless belt and is suspended over the transfer roller 27 and a tension roller 28. The transfer belt 21 is structured to rotate in the belt transfer direction (sub-scanning direction) by the transfer roller 27 rotationally driven by a sub-scanning motor 31 via a timing belt 32 and a timing roller 33. A guiding member 29 is provided on the rear side of the transfer belt 21 while corresponding to the image formation area of the recording head 7. In addition, the charging roller 26 is in touch with the surface layer of the transfer belt 21 and is arranged to be rotationary driven by the rotation of the transfer belt 21.

The reverse portion (reverse path) that reverses the paper 12 is formed of the surface of the transfer roller 27 over which the transfer belt 21 is suspended and members facing the transfer roller 27. The registration roller 22 is situated on the upstream side of the position where the paper 12 is completely reversed by the transfer belt 27 relative to the direction of feeding the paper 12. The transfer roller 27 forms a pair of rotation rollers with the registration roller 22.

As illustrated in FIG. 2, an encoder wheel 34 is attached to the axis of the transfer roller 27 and an encoder sensor 35 that reads the encoder wheel 34 is provided. The encoder wheel 34 and the encoder 35 form a rotary encoder 36. In addition, as illustrated in FIG. 1, an encoder scale 42 is arranged along the main scanning direction of the carriage 3 and an encoder sensor 43 that reads the encoder scale 42 is provided to the carriage 3. The encoder scale 42 and the encoder sensor 43 form a linear encoder 44.

In addition, a first paper sensor 70 is attached to one side of the carriage 3 along the main scanning direction to detect the front end of the paper 12. Furthermore, a second paper sensor 71 is arranged facing the transfer roller 21 to detect the rear end of the paper 12 on the upstream side of the pressure roller 25 relative to the direction of the paper transfer.

Furthermore, a paper discharge portion that discharges the paper 12 on which an image is recorded by the recording head 7 is provided and includes a separation claw 51 to separate the paper 12 from the transfer belt 21, a discharging roller 52, a discharging roller (spur) 53 and a discharging tray 54 where the discharged paper 12 is stocked.

In addition, a duplex paper feeder unit 61 is detachably attached to the back. The duplex paper feeder unit 61 draws in and reverses the paper 12 that is returned by the reverse rotation of the transfer belt 21 and feeds the paper 12 again between the registration roller 22 and the transfer belt 21.

The position in the duplex paper feeder unit 61 where the paper 12 is drawn in is significantly the same as the position where the reverse of the paper 12 is complete and arranged at least on the downstream side of the pair of the rotation rollers (the transfer roller 27 and the registration roller 22 in the transfer path relative to the paper (recording medium) transfer (feeding) direction. The paper draw-in path to the duplex paper feeder unit 61 is used as the pull-in path where the paper is pulled in, which is described later.

Furthermore, as illustrated in FIG. 2, a maintenance and restoring mechanism 56 to maintain and restore the status of the recording head 7 is arranged in a non-image area on one side of the carriage 3 along the scanning direction. This maintenance and restoring mechanism 56 includes caps 57 to cap respective nozzle phases of the recording head 7, a wiper blade 58 functioning as the blade member to wipe off the nozzle phases, and an empty discharging receiver 59 that receives a liquid droplet discharged by empty discharging by which liquid droplets not contributable to recording are discharged to discharge thickened recording liquid.

In the thus structured image forming apparatus, the paper 12 is separately fed from the paper feeder unit one by one and transferred upward perpendicularly while guided by the guide 15. Then, the paper 12 is transferred while pinched between the transfer belt 12 and the registration roller 22. Thereafter, the front end of the paper 12 is guided by the transfer guide 23 and the paper 12 is pressed against the transfer belt 21 by the pressure roller 25 so that the transfer direction is converted approximately 90° (i.e., reversed).

At this point, an AC bias supply unit applies an alternate voltage in which plus and minus voltages are alternately repeated to the charging roller 26 by a control unit (not shown). Thus, the transfer belt 21 is charged by a charging voltage pattern, which is that plus and minus voltages are alternately applied with a particular width in the sub-scanning direction which is the circulating direction of the transfer belt 21. When the paper 12 is fed onto the charged transfer belt 21, the paper 12 is electrostatically attached to the transfer belt 21. In the case in which the pull-in operation is not involved, the paper 12 is just transferred along the sub-scanning direction to the image formation position of the recording head 7 by the circulation movement of the transfer belt 21.

The recording head 7 is driven according to the image signal while moving the carriage 3 outward and homeward and discharges ink droplets to the paper 12 not in motion to record an amount of one line. Then, the paper 12 is moved with a predetermined amount to be ready for recording at the next line. When a recording complete signal or a signal that the rear end of the paper 12 reaches the recording area is received, the recording operation completes and the paper 12 is discharged to the discharging tray 54.

When recording on the front surface (subject to first printing) is finished in the duplex mode, the recorded paper 12 is sent into the duplex paper feeder unit 61 by reversely rotating the transfer belt 21. The paper 12 is reversed at the reverse path formed by a first reverse roller 62, a second reverse roller 63, a pressure roller 64, etc. so that the bottom face of the paper 12 is ready for recording. The paper 12 is fed between the registration roller 22 and the transfer belt 21 again and transferred to the transfer belt 21 as described above while the timing is controlled. After recording on the bottom surface of the paper 12, the paper 12 is discharged to the discharging tray 54.

In addition, the carriage 3 on standby for printing (recording) is moved to the side of the maintenance and restoring mechanism 56 and the nozzle phase of the recording head 7 is capped by the cap 57 to keep the nozzle in wet state so that bad discharging due to dried ink is prevented. The restoring operation to discharge thickened recording liquid or air bubble is performed by sucking the recording liquid from the nozzle while the recording head 7 is capped by the cap 57. Ink attached to the nozzle phase of the recording head 7 during this restoring operation is removed by wiping-off by a wiper blade 58. Empty discharging is operated before or during recording to discharge ink not involved with recording, thereby keeping stable discharging performance of the recording head 7.

Figure 3:
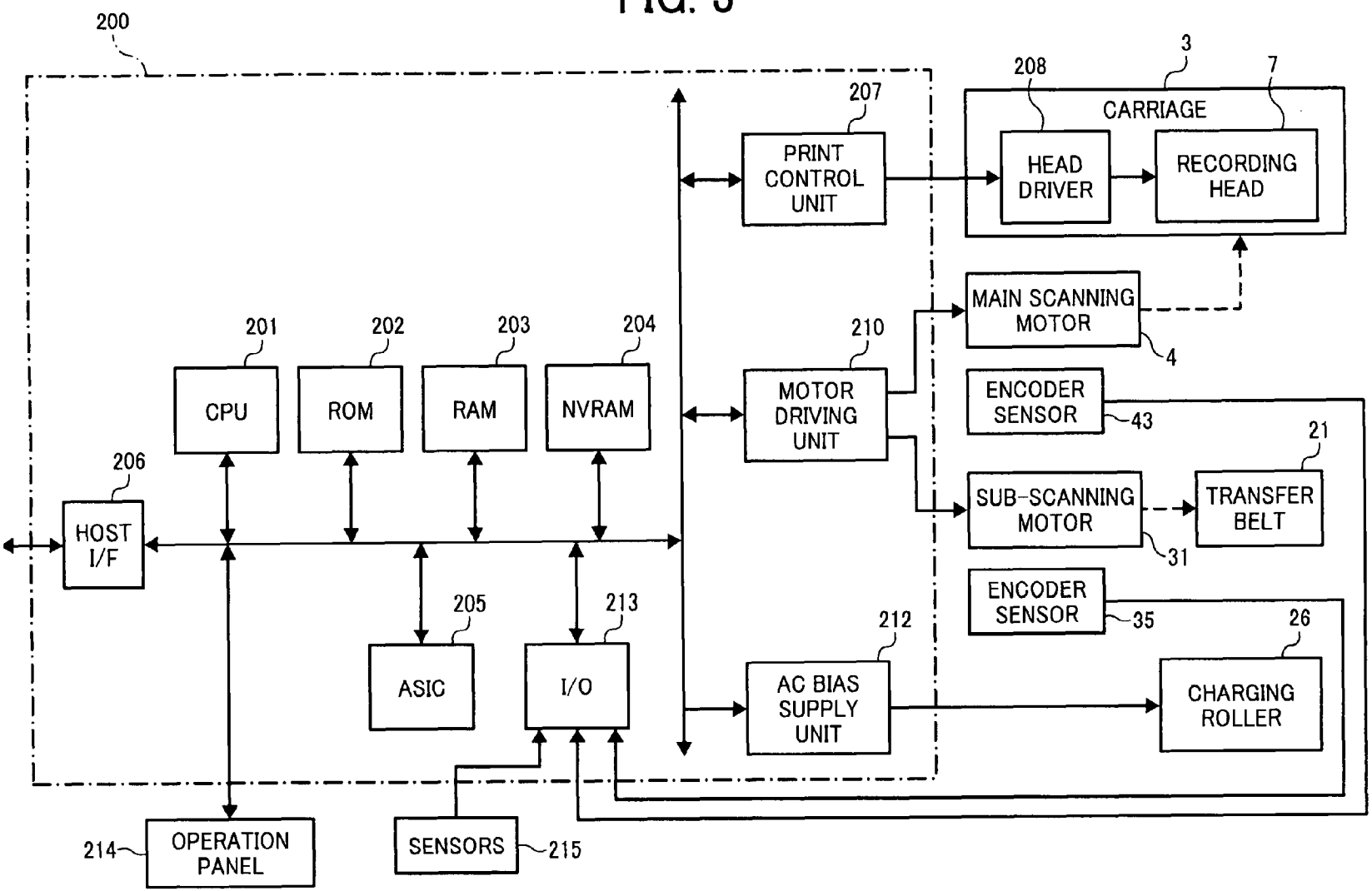
FIG. 3 is a block chart schematically illustrating the control unit of the image forming apparatus of FIG. 1.

Next, the control unit of the image forming apparatus is briefly described with reference to the block chart of FIG. 3.

This control unit 200 includes a CPU 201, a ROM 202, a RAM 203, a nonvolatile memory (NVRAM) 204, and an ASCC 205. The CPU 201 controls the entire image forming apparatus. The ROM 202 stores programs including programs related to the present invention performed by CPU 201 and other fixed data. The RAM 203 temporarily stores image data, etc. The non-volatile memory 204 is a rewritable memory which keeps data while the power of the image forming apparatus is off. The ASIC 205 processes various kinds of signals for image data, performs image-processing such as re-arrangement, and processes I/O signals to control the entire image forming apparatus.

In addition, the control unit 200 includes an I/F 206, a print control unit 207, a head driver (driver IC) 208, a motor driving unit 210, an AC bias supply unit 212, an I/O 213, etc. The I/F 206 sends and receives signals and data with a host (main) computer. The print control unit 207 includes a data transfer device to drive and control the recording head 7 and a driving waveform generation device. The head driver 208 drives the recording head 7 provided on the side of the carriage 3. The motor driving unit 210 drives the main scanning motor 4 and the sub-scanning motor 31. The AC bias supply unit 212 supplies an AC bias to the charging roller 34. Each detected signal from the encoder sensors 43 and 35 and other sensors 215 is input into the I/O 213. The sensor groups 215 include at least the first and second paper sensors 70 and 71, and a temperature sensor to detect the environment temperature which is a factor causing displacement of the dot formation position.

An operation panel 214 where information required for the image forming apparatus is input and displayed is connected to the control unit 200.

The control unit 200 receives image data at I/F 206 via a cable or a network from a data processing apparatus such as a home computer, an image reading device such as an image scanner and an image pickup such as a digital camera from the host computer.

The CPU 201 of the control unit 200 reads and analyzes the print data in the receiver buffer contained in the I/F 206, performs required image-processing and re-arrangement of data at the ASIC 205 and transfers the image data from the print control unit 207 to the head driver 208. The dot pattern data for use in image output are generated at a printer driver on the host computer, which is described later.

The print control unit 207 transfers the image data described above to the head driver 208 in serial data form. In addition to this image data transfer, transfer clock for use in confirmation of the transfer, and output of latch signals and droplet control signals (mask signals) to the head driver 208, the print control unit 207 includes a D/A converter to D/A-convert the pattern data of driving signals stored in the ROM 202, a driving waveform generation unit formed of a voltage amplifier, a current amplifier, etc. and a selector to select the driving waveform provided to the head driver 208 to generate and output a driving waveform formed of one or more driving pulses (driving signals) to the head driver 208.

The head driver 208 drives the recording head 7 by applying a driving signal forming a driving waveform provided by the print control unit 207 based on serially input image data corresponding to an amount of a line of the recording head 7 to a driving element (e.g., the piezoelectric element described above) that generates energy for selectively discharging liquid droplets in the recording head 7. Dots of large-sized droplets, middle-sized droplets, small-sized droplets, etc. can be discharged by selecting a driving pulse forming the driving waveform.

In addition, the CPU 201 calculates a driving output value (control value) for the main scanning motor 4 based on the velocity detection value, the position detection value, the velocity target value and the position target value to drive the main scanning motor 4 via the motor drive unit 210. The velocity detection value, and the position detection value are obtained by sampling the detection pulse from the encoder sensor 43 forming the linear encoder 44. The velocity target value and the position target value are obtained by a preliminarily stored velocity and position profile. Similarly, the CPU 201 calculates a driving output value (control value) for the sub-scanning motor 31 based on the velocity detection value, the position detection value, the velocity target value and the position target value to drive the sub-scanning motor 31 via the motor drive unit 210. The velocity detection value and the position detection value are obtained by sampling the detection pulse from the encoder sensor 35 forming the rotary encoder 36. The velocity target value and the position target value are obtained by a preliminarily stored velocity and position profile.

Figure 4:
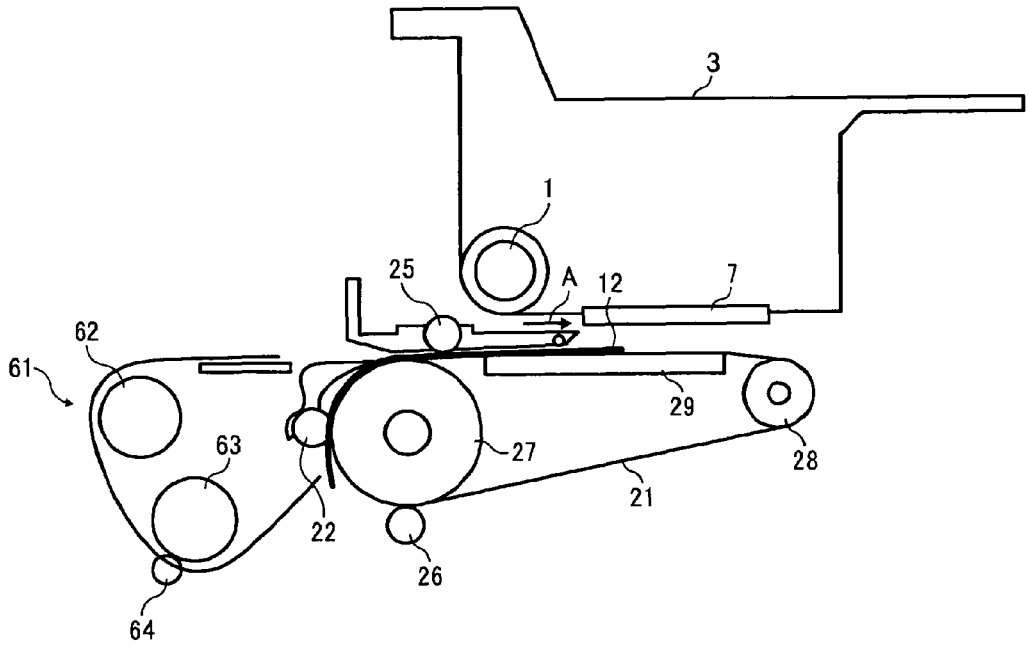
FIG. 4 is a diagram illustrating a status in which the rear end of a recording medium (paper) is pinched at the contact portion of a pair of the rollers to describe the dot displacement ascribable to the vibration (fluttering) of the rear end of the paper during paper transfer.

Next, displacement of dot landing positions caused by vibration (fluttering) at the rear end of paper during paper transfer in such an image forming apparatus is described with reference to FIGS. 4 and 5.

As described above, the paper 12 fed from the paper feeder cassette 10 is pinched between the registration roller 22 and the transfer roller 2 and attached to the transfer belt 21 on the surface of the transfer roller 27. Thereafter, the paper feeding direction is reversed. Then, as illustrated in FIG. 4, the paper 12 is forwarded along the direction indicated by an arrow A.

The front end of the paper 12 is detected by the first paper sensor (reflection type sensor) 70 and the distance calculated by the timing (the number of pulses) and/or the transfer speed is stored in the RAM 203. The paper 12 the front end of which is detected is transferred to the image formation position of the recording head 7 while being pressed by the registration roller 22 and the pressure roller 25 against the transfer roller 27 and the transfer belt 21.

Thereafter, the recording head 7 forms the first line of an image while moving the recording head 7 along the main scanning direction and transfers the paper 12 in a predetermined amount to be ready for recording the next line.

Figure 5:
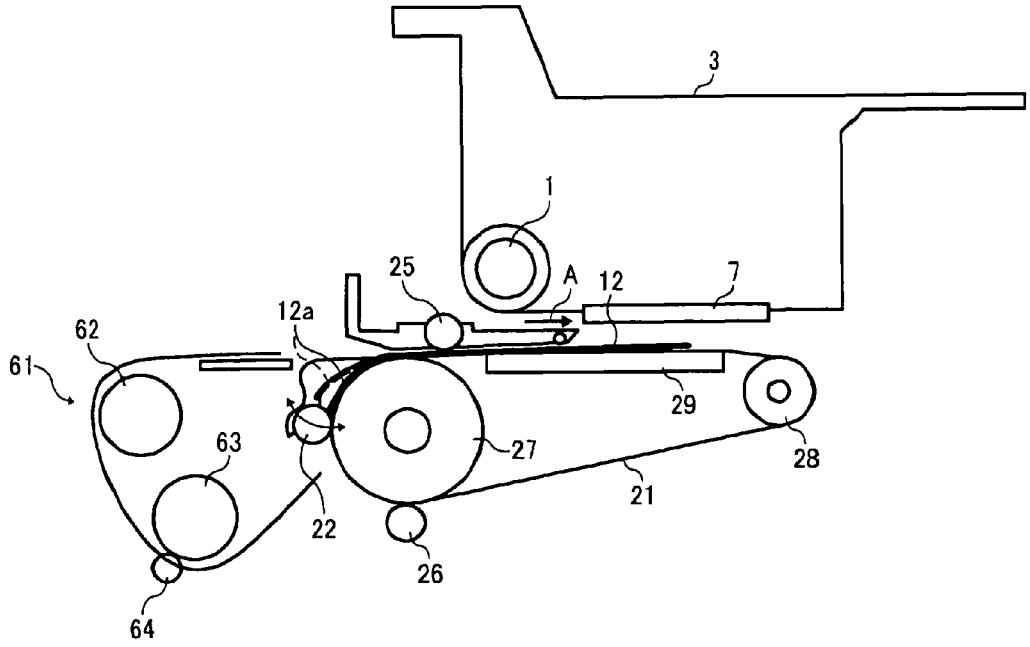
FIG. 5 is a diagram illustrating a status in which the rear end of a recording medium (paper) has passed through the contact portion.

However, as illustrated in FIG. 5, when the paper 12 used is stiff, as soon as a rear end 12*a* of the paper 12 has passed through the nip portion where the registration roller 22 and the transfer roller 27 are in contact, the rear end 12*a* of the paper 12 may be jerked upward as indicated by a dotted line and vibrate in the direction indicated by an arrow. Consequently, the load on the paper 12 greatly varies, which leads to variance in the transfer amount of the paper 12. This may cause displacement of the relative position of the recording head 7 to the paper 12.

Therefore, if images are formed in such a state, the actual position of the dot formed on the paper 12 by ink discharging from the recording head 7 is displaced from the position that should be. Thus, the recording grade (image quality) deteriorates.

A first embodiment of the present invention is described with reference to schematic diagrams of FIGS. 6 to 8 and a flow chart that illustrates the processing of the paper transfer control performed by the control unit 200.

Figure 6:
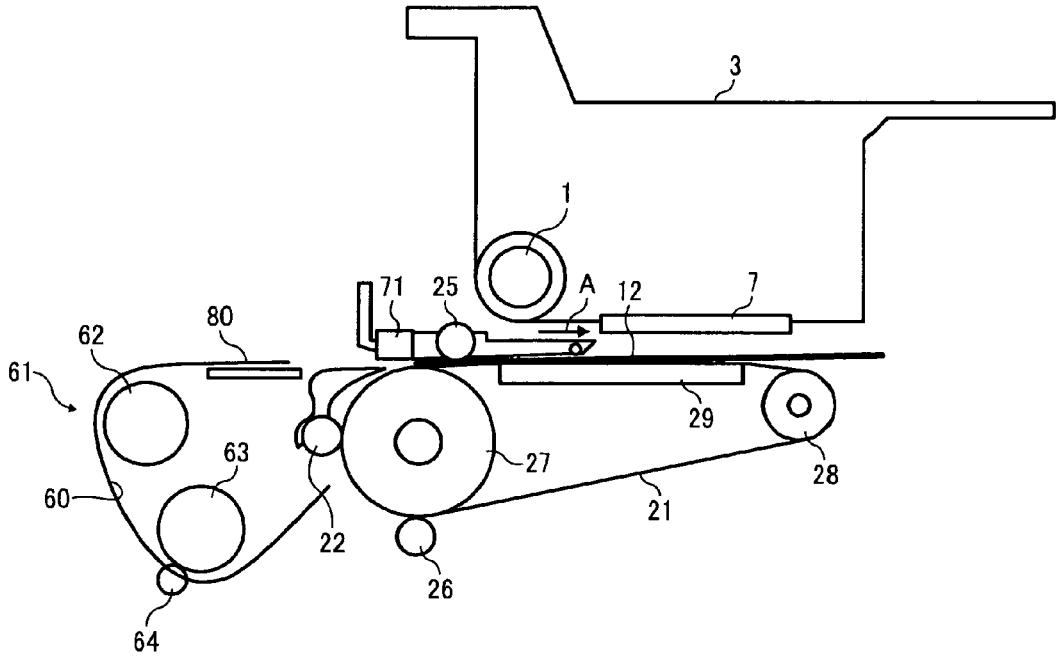
FIG. 6 is a diagram illustrating a status in which the rear end of the paper is detected to describe a first embodiment of the present invention, which is described later.
Figure 7:
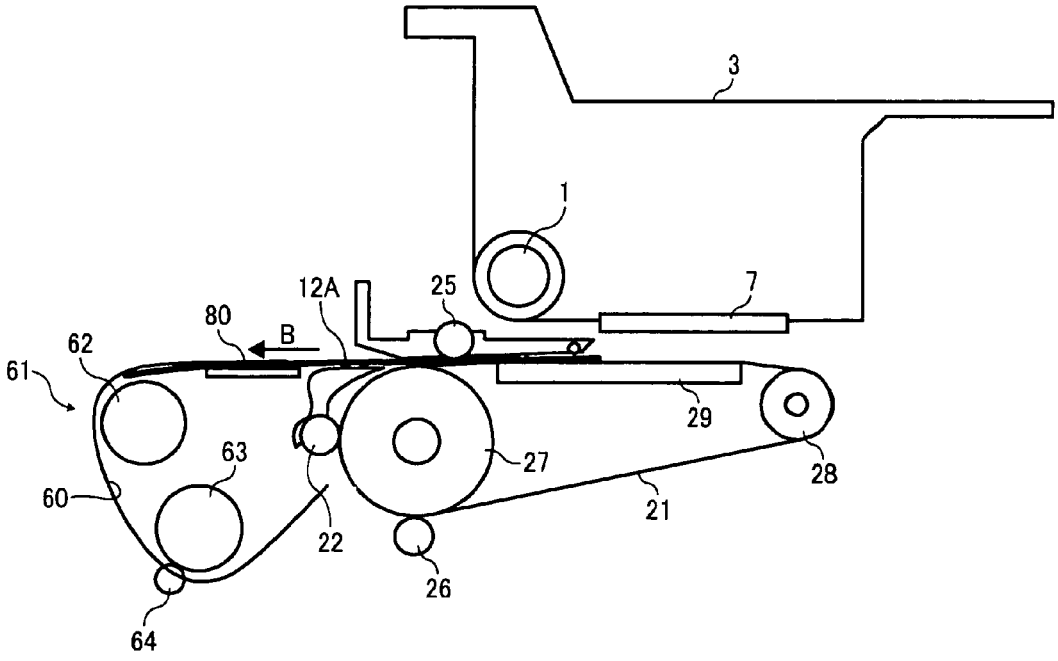
FIG. 7 is a diagram illustrating a status of the first embodiment in which the paper is pulled in to the pull-in path.

As described above, the paper 12 fed by rotationarily driving the transfer roller 27 is transferred to the direction indicated by an arrow A as in FIG. 6.

When the rear end of 12*a* of the paper 12 passes through the nip portion where the registration roller 22 and the transfer roller 27 are in contact, and the second paper sensor (reflection type sensor) 71 detects the rear end 12*a* of the paper 12, the paper 12 is transferred in the direction indicated by an arrow B by reversely rotating the transfer roller 27. As in FIG. 7, the paper 12 is pulled back into a pull-in path 80 that has no reverse portion (reverse path) and a pair of rotation rollers. The pull-in path 80 is formed of part of a duplex transfer path 60 in the duplex unit 61, which is the portion that includes no rotation rollers (the first reverse roller 62 and the second rotation roller 63) in the pull-in range (distance) of the paper 12.

Figure 8:
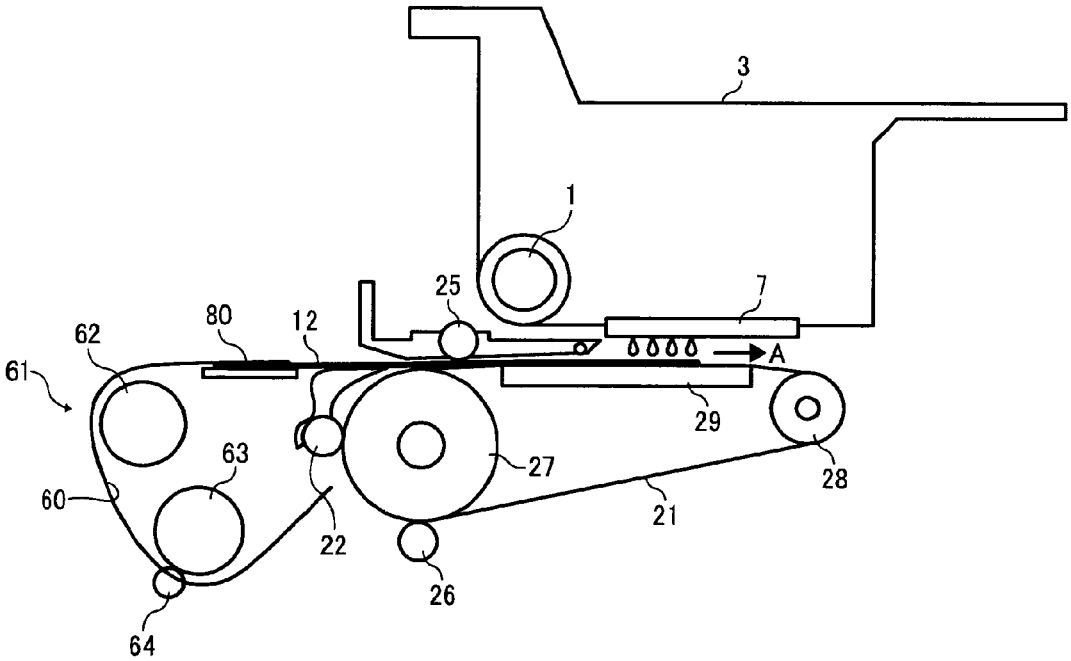
FIG. 8 is a diagram illustrating a status of the first embodiment in which the paper is transferred back toward the image formation position to print an image on the paper.
Figure 9:
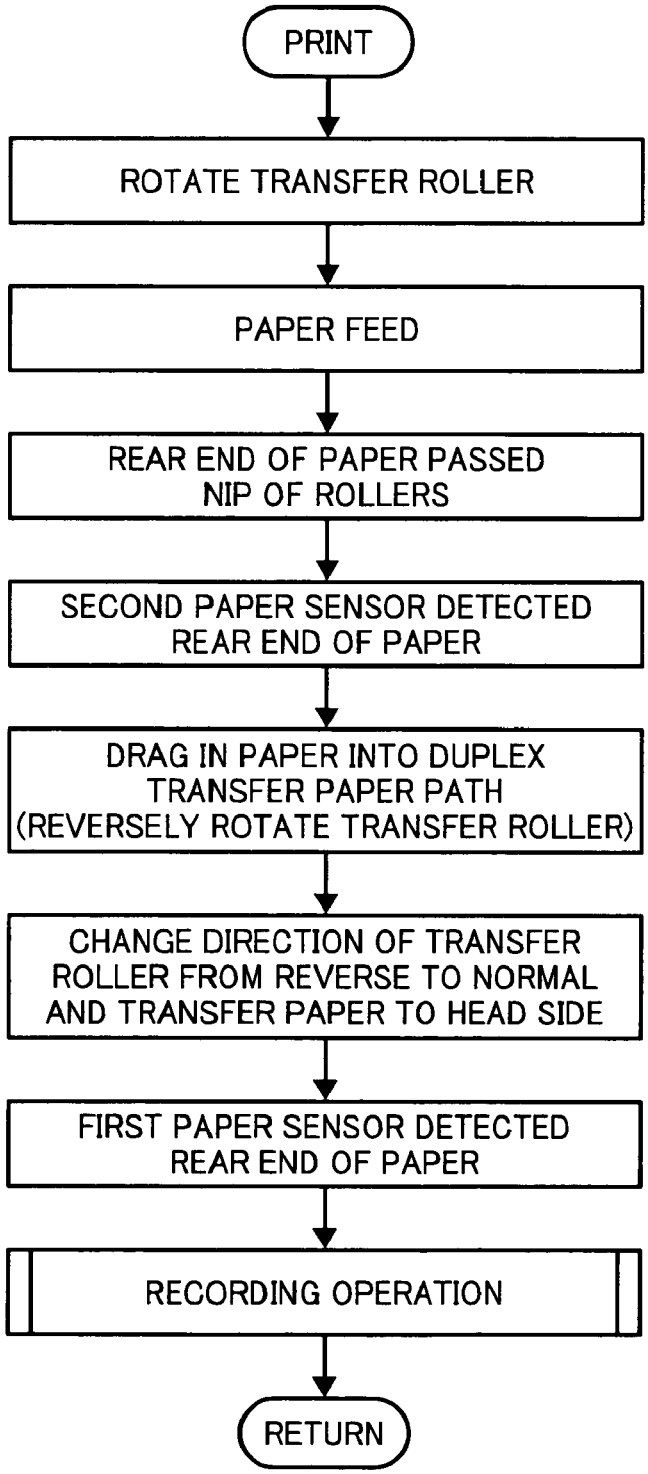
FIG. 9 is a flow chart illustrating the processing of paper transfer control of the first embodiment.

Thereafter, as illustrated in FIG. 8, the transfer roller 27 is properly rotated to transfer the paper 12 to the image formation position of the recording head 7 again. The first paper sensor 70 detects the front end of the paper 12 followed by recording (image formation). Since the pull-in path 80 does not have a reverse unit or rotation rollers in the pull-in range (distance), the vibration (fluttering) of the rear end of the paper 12 does not occur when the paper 12 passes through the registration roller 22 and the transfer roller 22. Thus, the paper 12 is continuously, stably and accurately fed.

Slipping between the paper 12 and the transfer belt 21 while the paper 12 is being transferred from the pull-in path 80 results in the print displacement. Therefore, this slipping is necessary to prevent.

In this case, at least one of the transfer speed and the speed of acceleration (each speed of acceleration to drive the transfer roller 27) when the paper 12 is transferred back (i.e., when the paper 12 is transferred from the pull-in path 80 along the direction indicated by the arrow A) is preferred to be slower than the transfer speed and the speed of acceleration when the paper 12 is normally transferred by the transfer belt 21 and the registration roller 22. According to the experiment, slipping between the transfer belt 21 and the paper 12 can be completely avoided when the transfer speed and the speed of acceleration are reduced to a half of the normal transfer speed and speed of acceleration although depending on the attachment force between the transfer belt 21 and the paper 12.

Thus, deterioration of transfer accuracy occurring when the rear end of paper passes through the pair of rotation rollers situated on the upstream side of the reverse portion is reduced so that the quality of images ameliorates by such a simple structure having: a transfer path at which paper (recording medium) is reversed and transferred to the image formation position of an image formation device; a pair of rotation rollers that pinch the paper at a position on the upstream side of where the reverse of the paper is complete relative to the paper transfer direction; a pull-in path which is provided on the downstream side of the pair of the rotation rollers of the transfer path relative to the paper transfer direction and where the paper is pulled in (back); and a control device to temporarily pull in the paper to the pull-in path after the rear end of the paper passes through the pair of the rotation rollers when the paper is fed via the transfer path, while no pair of rollers that impart a transfer force to the paper are not provided in the pull-in (back) range of the paper in the pull-in path.

Figure 10:
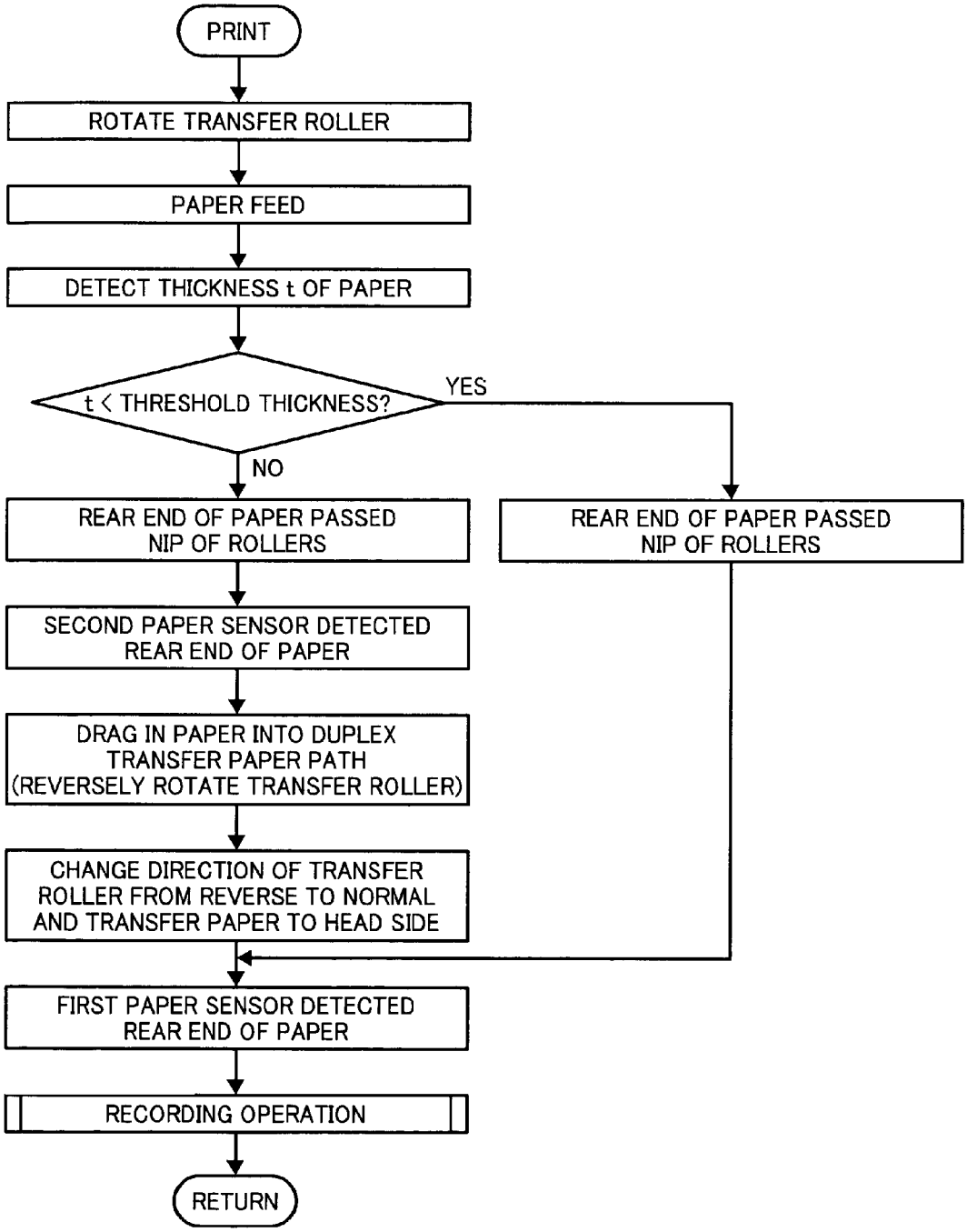
FIG. 10 is a flow chart illustrating the processing of paper transfer control of a second embodiment, which is described later.

Next, a second embodiment of the present invention is described with reference to FIG. 10. FIG. 10 is a flow chart that illustrates the processing of the paper transfer control in this embodiment.

In the embodiment, a detection device that detects the thickness of the paper 12 is provided on the upstream side of the registration roller 22 relative to the paper transfer direction to detect whether or not the paper 12 is thinner than a predetermined thickness. When the paper 12 is thinner than the predetermined thickness, the image is formed on the paper 12 without pulling in the paper 12 to the pull-in path 80. To the contrary, when the paper 12 is thicker than the predetermined thickness, the paper 12 is pulled in to the pull-in path 80 first as described above and then transferred back toward the image formation position where the image is formed.

Since vibration hardly occurs to thin paper at the rear end thereof when the thin paper passes through the contact portion between the registration roller 22 and the transfer roller 27, the productivity of image formation on thin paper is improved in such a system. In addition, print disorder when thick paper such as a post card is used can be prevented. The image forming apparatus used in the experiment is confirmed to have a displacement of print position of 2 μm or less for paper (recording medium) having a thickness of less than 120 μm when the roller nip is open, meaning that displacement of print position that has an adverse impact on the image quality hardly occurs.

Figure 11:
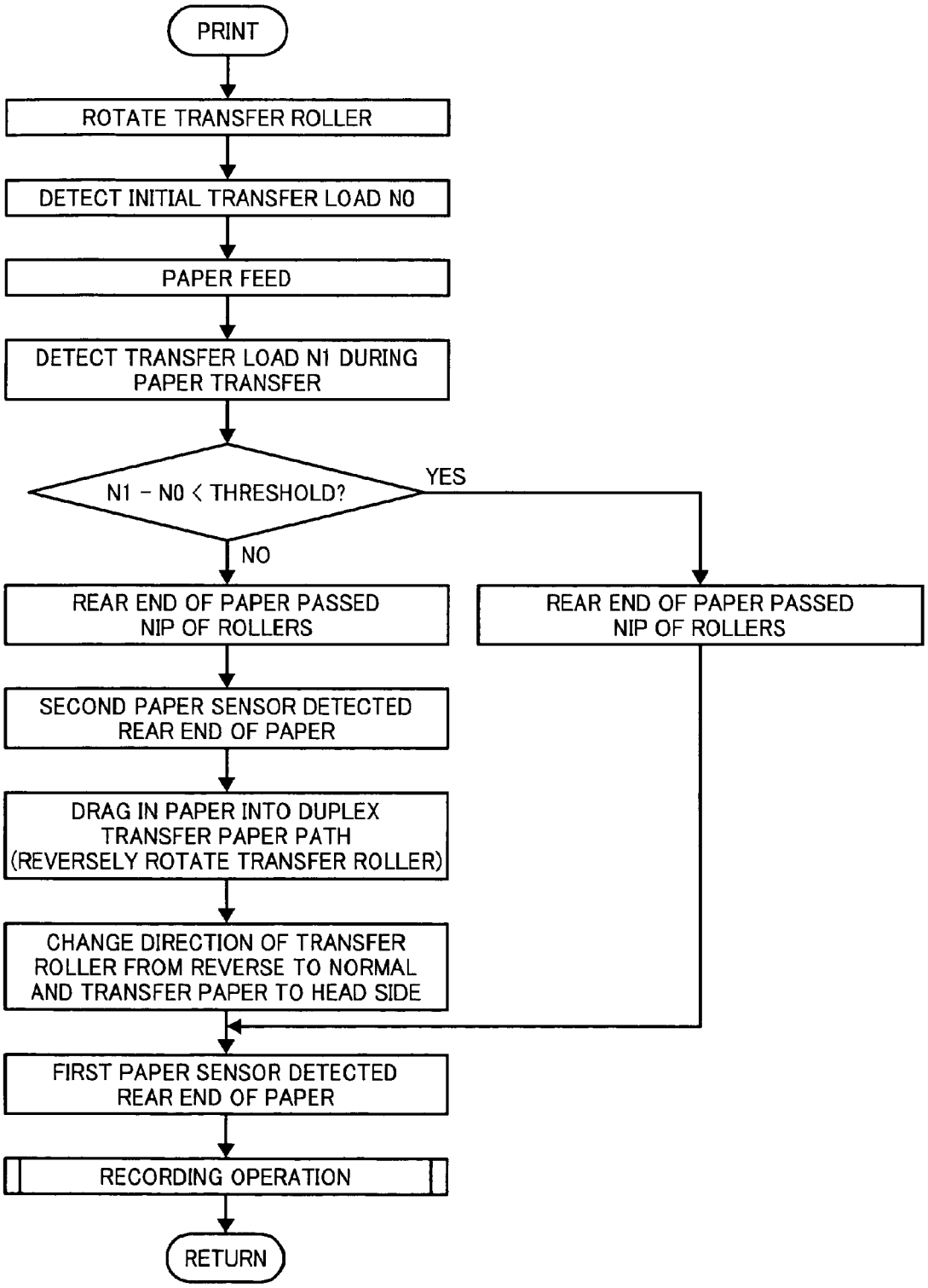
FIG. 11 is a flow chart illustrating the processing of paper transfer control of a third embodiment, which is described later.

Next, a third embodiment of the present invention is described with reference to FIG. 11. FIG. 11 is a flow chart illustrating the processing of paper transfer control of this embodiment.

The transfer roller 21 is properly rotated to detect an initial transfer load N0 thereof and a transfer load N1 thereof during transfer of the paper 12. In addition, the current value of a DC motor (sub-scanning motor 31) or the transfer amount of the registration roller 22 can be suitably used to detect the transfer load of the transfer roller 21.

Whether the difference between the transfer load N1 during paper transfer and the initial transfer load N0 is smaller than a predetermined value is determined. When the difference of (N1−N0) is smaller than the predetermined value, images are formed (recorded) without pulling in the paper 12 to the pull-in path 80. When the difference of (N1−N0) is equal, to or larger than the predetermined value, the paper is pulled in to the pull-in path 80 and then transferred back toward the image formation position where an image is recorded (formed).

The transfer load increases as the thickness of the paper 12 increases. Therefore, the productivity for thin paper having a small transfer load is improved since the vibration hardly occurs to such thin paper when the rear end of the paper 12 passes through the contact portion between the registration roller 22 and the transfer roller 27. In addition, print displacement is prevented for thick paper having a large transfer load. The image forming apparatus used in the experiment is confirmed to have a small displacement of print position for paper (recording medium) having a difference between the transfer loads of 150 (mN·m) or less when the roller nip is open, meaning that displacement of print position that has an adverse impact on the image quality hardly occurs.

Figure 12:
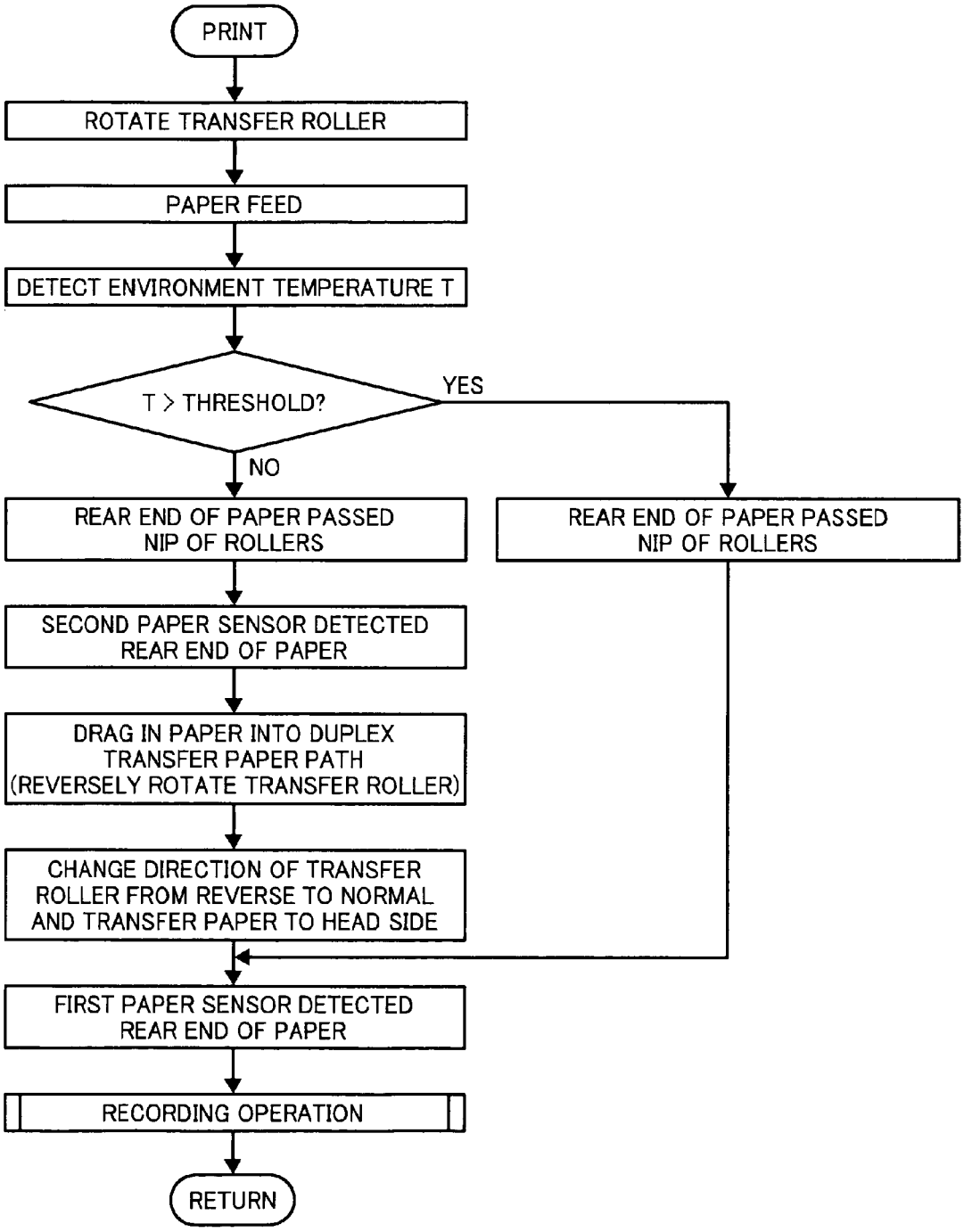
FIG. 12 is a flow chart illustrating the processing of paper transfer control of a fourth embodiment, which is described later.

Next, a fourth embodiment of the present invention is described with reference to FIG. 12. FIG. 12 is a flow chart illustrating the processing of paper transfer control of this embodiment.

The transfer roller 21 is properly rotated to detect the environment temperature T and whether the detected temperature is higher than a predetermined temperature is determined. When the environment temperature is higher than the predetermined temperature, images are formed (recorded) without pulling in the paper 12 to the pull-in path 80. When the environment temperature is equal to or lower than the predetermined temperature, the paper is pulled in to the pull-in path 80 and then transferred back toward the image formation position where an image is recorded (formed).

The environment temperature and stiffness of paper are known to have a strong relationship. In particular, paper becomes extremely stiff in an environment where the temperature is 15° C. or lower. The productivity is improved at an environment temperature at which the paper hardly vibrates when the rear end of the paper passes through the contact portion between the registration roller 22 and the transfer roller 27. In addition, print displacement at an environment temperature at which the stiffness of the paper increases can be prevented.

Next, a fifth embodiment of the present invention is described. Whether the paper 12 is pulled in to the pull-in path 80 or an image is formed on the paper 12 without pulling in the paper 12 to the pull-in path 80 depends on the temperature history of the environment in which the paper 12 (image forming apparatus) is left alone instead of the temperature when the image are formed as described in the fourth embodiment. The temperature history of the environment is stored in a non-volatile memory such as the NVRAM 204. Therefore, the print displacement occurring when the rear end of the paper 12 passes through the contact portion between the registration roller 22 and the transfer roller 21 is prevented not to have an adverse impact on the image formation even on an early winter morning.

Directly detecting the temperature of the paper 12 is also suitable to make an efficient determination.

Furthermore, when installation of a temperature sensor is difficult in terms of cost, designing, and space, data such as region of usage, and date of usage are obtained from a main (host) computer to predict the environment temperature and the temperature of the paper 12 and determine whether the paper is pulled in to the pull-in path 80 or the image is formed on the paper without pulling in the paper 12 to the pull-in path 80 based on the predicted temperature. For example, the temperature and the humidity can be predicted by storing data such as daily or monthly average temperature and humidity information of a region in the past in a memory and obtaining the information of the region of usage and date of usage from the data processing device (main computer).

Figure 13:
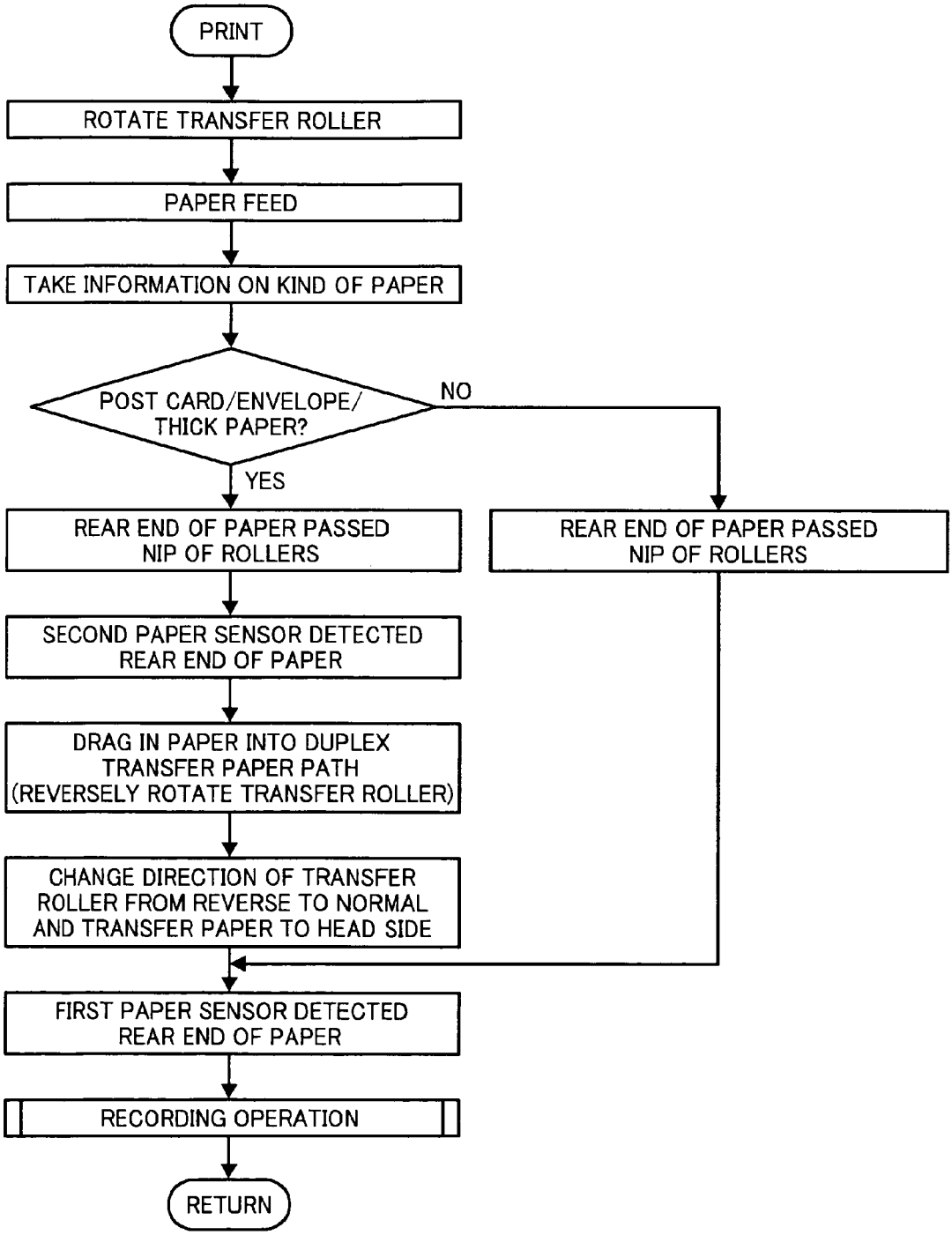
FIG. 13 is a flow chart illustrating the processing of paper transfer control of a sixth embodiment, which is described later.

Next, a sixth embodiment of the present invention is described with reference to FIG. 13. FIG. 13 is a flow chart illustrating the processing of paper transfer control of this embodiment.

Whether the paper 12 is pulled in to the pull-in path 80 or an image is formed on the paper 12 without pulling in the paper 12 to the pull-in path 80 depends on the kind of paper 12. Specifically, information on the kind of paper 12 input from a host computer or the operation panel 214 or information on the kind of the detected paper 12 is obtained. When the paper input from a main computer or detected is a post card, an envelope, or thick paper, the paper 12 is pulled in before the image formation. When the paper is other kinds of paper, images are formed without pulling in the paper 12 to the pull-in path 80.

Therefore, dot displacement occurring when the rear end of the paper passes through does not have an adverse impact on the image formation while the productivity is efficiently improved.

In addition, since post cards stiffen as the temperature lowers, dot displacement tends to occur when an image is formed on a post card in a low temperature environment (in some experiment, this displacement surpasses 100 μm). Therefore, pulling in the paper 12 to the pull-in path 80 only when conditions such as the kind of paper, environment temperature, etc., are overlapped is also efficient in terms of the productivity.

Figure 14:
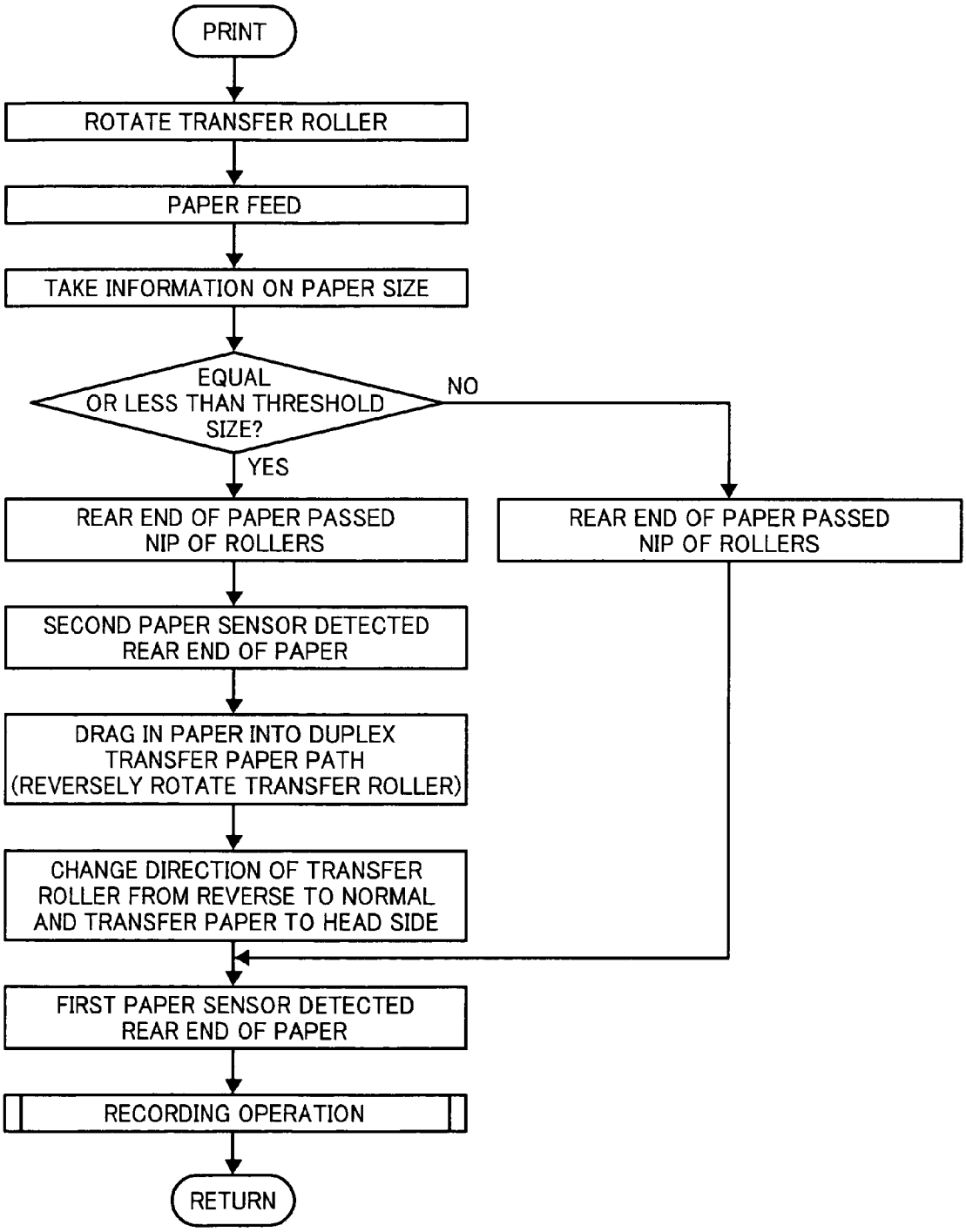
FIG. 14 is a flow chart illustrating the processing of paper transfer control of a seventh embodiment, which is described later.

Next, a seventh embodiment of the present invention is described with reference to FIG. 14. FIG. 14 is a flow chart illustrating the processing of paper transfer control of this embodiment.

Whether the paper 12 is pulled in to the pull-in path 80 or an image is formed on the paper 12 without pulling in the paper 12 to the pull-in path 80 depends on the paper size (length and/or width of the paper 12). Specifically, information on the size of paper 12 input from a host computer or the operation panel 214 or information on the detected size of the paper 12 is obtained. The paper having a size equal to or smaller than a predetermined size is pulled in to the pull-in path 80 before the image formation but the paper having a size larger than the predetermined size is directly transferred to the image formation position without being pulled in to the pull-in path 80.

Vibration at the rear end of paper after the paper passes through the contact portion of the rollers tends to occur to paper having a small size rather than large-sized paper. Therefore, dot displacement occurring after the rear end of the paper passes through the contact portion hardly has an adverse impact on the image formation in the case of paper having a small size. This is because the paper 12 is pulled in to the pull-in path 80 before the image formation. In addition, the productivity is efficiently improved.

In addition, the kind of paper described in the sixth embodiment can be inferred from the paper size by referring to a data table containing preset paper length and kind of paper to determine whether to pull in the paper 12 to the pull-in path 80 according to the kind of paper.

The second paper sensor 71 can be used to detect the length of the paper 12 or load variances can be also suitably used. The length of the paper can be obtained by the paper size data input from the host computer. The first paper sensor 70 is suitably used to detect the paper width or the width of the registration roller 22 to which a load is applied. In addition, the paper width can be obtained by using the paper size data input from the host computer.

The duplex feeder unit 61 is used in the embodiments described above. Also, a manual tray from which the recording medium (paper 12) is manually fed can be provided to the image forming apparatus and provides a draw-in path where the recording medium is pulled in as in the cases of the duplex feeder unit 61. Therefore, the embodiments described above can be applied to such a manual tray.

The image forming apparatus of the present invention can be applied to a facsimile machine, a photocopier, a multifunctional machine of a printer, facsimile machine and a photocopier, etc. in addition to an ink jet printer. Furthermore, the present invention is applicable to a device in a field such as the resist field using liquid (recording liquid) other than ink, and an image forming apparatus in the medical field that forms images by discharging a DNA sample.

This document claims priority and contains subject matter related to Japanese Patent Application No. 2008-189178, filed on Jul. 22, 2008, the entire contents of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming apparatus comprising:

an image formation device configured to form an image on a recording medium at an image formation position;

a transfer path configured to reverse and transfer the recording medium to the image formation position;

a pair of rotation rollers provided upstream from the image formation device relative to a transfer direction of the recording medium and configured to nip the recording medium in the transfer path at an upstream position relative to a position where the recording medium is completely reversed;

a pull-in path provided at a downstream position relative to the pair of rotation rollers situated in the transfer path, to which the recording medium is pulled in; and a transfer control device configured to control pulling in the recording medium from the image formation position to the pull-in path by reversing the transfer direction of the recording medium after a rear end of the recording medium passes through the pair of rotation rollers and before completing forming an image on a side of the recording medium, and then transferring the recording medium back to the image formation position by reversing the transfer direction of the recording medium again, when the recording medium is fed and transferred to the image formation position in the transfer path.

2. The image forming apparatus according to claim 1, wherein the pull-in path is at least part of a duplex transfer path through which the recording medium is re-fed at duplex printing.

3. The image forming apparatus according to claim 1, wherein the transfer control device controls pulling in the recording medium to the pull-in path based on at least one of thickness of the recording medium, kind of the recording medium, length of the recording medium, length and width of recording medium, load applied when the recording medium is transferred, environment temperature, history of environment temperature, date of usage, and region of usage.

4. The image forming apparatus according to claim 1, wherein the transfer control device controls a transfer speed of the recording medium when the recording medium is transferred back toward the image formation position after the recording medium is pulled in to the pull-in path to be slower than that of the recording medium when the recording medium is not pulled in to the pull-in path.

5. The image forming apparatus according to claim 1, wherein the transfer control device controls an acceleration of transfer speed of the recording medium when the recording medium is transferred back toward the image formation position after the recording medium is pulled in to the pull-in path to be slower than that of the recording, medium when the recording medium is not pulled into the pull-in path.

6. The image forming apparatus according to claim 1, wherein no pair of rollers that impart a transfer force to the recording medium is provided in a pull-in range of the recording medium in the pull-in path.

7. The image forming apparatus according to claim 1, wherein, after the recording medium is pulled in to the pull-in path, the recording medium is transferred again toward the image formation device without reversing the side on which the image is formed.

* * * * *